US008568196B2

(12) United States Patent
Haworth

(10) Patent No.: US 8,568,196 B2
(45) **Date of Patent: *Oct. 29, 2013**

(54) BREAST SUPPORT SYSTEM FOR RECUMBENT WOMAN

(76) Inventor: Randal Haworth, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/314,753

(22) Filed: Dec. 8, 2011

(65) Prior Publication Data

US 2012/0208435 A1 Aug. 16, 2012

Related U.S. Application Data

(63) Continuation-in-part of application No. 12/697,340, filed on Feb. 1, 2010, now Pat. No. 8,187,053.

(60) Provisional application No. 61/148,647, filed on Jan. 30, 2009.

(51) Int. Cl.
*A41C 3/00* (2006.01)

(52) U.S. Cl.
USPC ..... 450/60; 450/62

(58) Field of Classification Search
USPC ..... 450/62–64, 60, 85, 86, 87
See application file for complete search history.

(56) References Cited

U.S. PATENT DOCUMENTS

| | | | | | |
|---|---|---|---|---|---|
| 2,092,390 | A | | 9/1937 | Federico | |
| 2,134,294 | A | * | 10/1938 | Yerkes | 450/59 |
| 2,287,769 | A | * | 6/1942 | Alberts | 450/87 |
| 2,344,237 | A | | 3/1944 | Dubner | |
| 2,362,974 | A | | 11/1944 | Cohen | |
| 2,367,353 | A | * | 1/1945 | Hunau | 450/87 |
| 2,406,699 | A | | 8/1946 | Lustig | |
| 2,478,103 | A | * | 8/1949 | Hunau | 450/87 |
| 2,497,324 | A | | 2/1950 | Schenkman | |
| 2,632,168 | A | * | 3/1953 | Kaufman | 450/87 |
| 2,688,749 | A | | 9/1954 | Cocks | |
| 2,697,228 | A | | 12/1954 | Orr | |
| 2,834,352 | A | | 5/1958 | Ullian | |
| 2,896,632 | A | | 7/1959 | Tullio | |
| 2,899,961 | A | | 8/1959 | Faron | |
| 2,923,301 | A | | 2/1960 | Tullio | |
| 2,986,143 | A | | 5/1961 | Erteszek | |
| 3,029,821 | A | | 4/1962 | Plehn | |
| 3,054,408 | A | | 9/1962 | Cousins | |
| 3,145,714 | A | | 8/1964 | Brown | |
| 3,164,154 | A | * | 1/1965 | Simonsen | 450/62 |
| 3,164,155 | A | * | 1/1965 | Simonsen | 450/62 |
| 3,166,077 | A | | 1/1965 | Laguzzi et al. | |
| 3,213,462 | A | * | 10/1965 | Ramsell | 450/62 |
| 3,710,800 | A | | 1/1973 | Carey | |
| 3,814,107 | A | | 6/1974 | Greenblatt et al. | |
| 4,372,321 | A | | 2/1983 | Robinson | |
| 7,044,829 | B1 | | 5/2006 | Jagaric et al. | |
| 7,056,187 | B2 | | 6/2006 | Cassity | |
| 7,549,908 | B2 | | 6/2009 | Yudkoff | |
| 8,016,640 | B2 | | 9/2011 | Morgan | |
| 8,187,053 | B2 | * | 5/2012 | Haworth | 450/59 |

OTHER PUBLICATIONS

Office Action from co-pending U.S. Appl. No. 12/697,340 (Sep. 7, 2011).

* cited by examiner

*Primary Examiner* — Gloria Hale
(74) *Attorney, Agent, or Firm* — Cermak Nakajima LLP; Adam J. Cermak

(57) ABSTRACT

A breast support system for a recumbent female human includes medial and lateral supports for each breast.

5 Claims, 4 Drawing Sheets

BREAST SUPPORT SYSTEM FOR RECUMBENT WOMAN

This application is a continuation-in-part of U.S. application Ser. No. 12/697,340, filed 1 Feb. 2010, by the inventor herein, now U.S. Pat. No. 8,187,053, which in turn claims priority under 35 U.S.C. §119 to U.S. provisional application No. 61/148,647, filed 30 Jan. 2009, the entireties of both of which are incorporated by reference herein.

BACKGROUND

1. Field of Endeavor

The present invention relates to devices, systems, and processes useful as breast supports, and more specifically to such devices and processes useful for supporting the breasts of a recumbent female human.

2. Brief Description of the Related Art

FIG. 3 illustrates the chest and breasts of a recumbent woman and the deleterious stresses and forces generated on breast tissue and adjacent tissue, when the woman lies on her side, by gravity. The perceived problem is two-fold:

1. When the woman is sleeping on her side, the uppermost breast falls down toward the midline, and often past it. This in turn causes stresses S on the medial and lateral breast skin and the underlying ligaments.

2. When a woman is lying on her back, both breasts fall laterally (to the sides) and often times into the axillae (armpits).

Eventually, these stresses on the breast tissues promote stretching of the skin and resultant breast psosis (drooping), widening of the breast, and vertically oriented breastbone skin creases C (over the woman's sternum). Additionally, the lower, inferior-most breast sustains laterally compressive and compacting forces F, which can lead to folding of the breast skin upon itself.

SUMMARY

According to a first aspect of the invention, a breast support system for a recumbent woman comprises a left medial support and a right medial support, the medial supports being joined together, a left lateral support and a right lateral support, wherein the left medial support is positioned adjacent to the left lateral support and forms a V-shape therewith configured and arranged to support a left breast of said recumbent woman, wherein the right medial support is positioned adjacent to the right lateral support and forms a V-shape therewith configured and arranged to support a right breast of said recumbent woman, and a strap system attached to both V-shapes, the strap system configured and arranged to extend over the shoulders of said recumbent woman, the strap system including a left lateral strap connected to the left lateral support and configured to extend over the woman's left shoulder, a right lateral strap connected to the right lateral support and configured to extend over the woman's right shoulder, a left medial strap connected to the left medial support and configured to extend over the woman's right shoulder, and a right medial strap connected to the right medial support and configured to extend over the woman's left shoulder.

Still other aspects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

The invention of the present application will now be described in more detail with reference to exemplary embodiments of the apparatus and method, given only by way of example, and with reference to the accompanying drawings, in which.

DETAILED DESCRIPTION OF EXEMPLARY EMBODIMENTS

Figure 1:
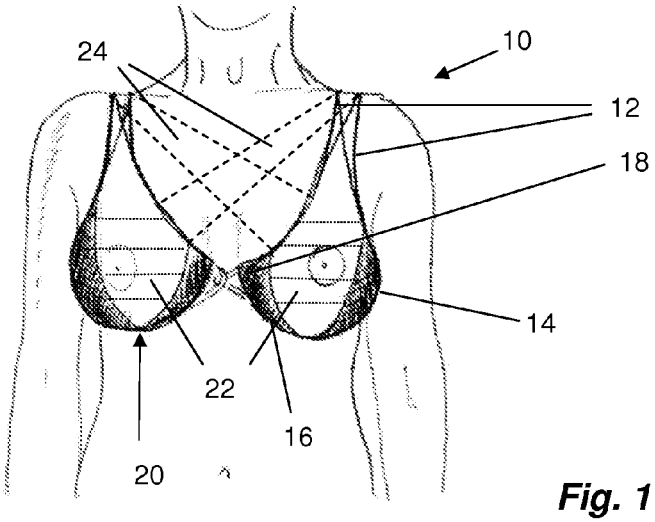
FIG. 1 illustrates a woman wearing an exemplary device embodying principles of the present invention.

Referring to the drawing figures, like reference numerals designate identical or corresponding elements throughout the several figures.

With reference to FIG. 1, an exemplary support system 10 is illustrated. The system includes at least one (preferably a pair) shoulder strap system 12, which are connected together on a back portion of the system (not illustrated) in a manner typical of brassieres. Each strap system 12 is connected to a lateral support or padding 14 and to a medial support or padding 16, for each breast. When such supports 14, 16 are provided in a pair, one set for each breast, they are advantageously attached together, such as via a clasp 18 or a more permanent connection. According to one exemplary embodiment, the lateral 14 and medial 16 supports together form a V-shape, including an open space 22 between the two supports. According to other exemplary embodiments, the open space 22 can be bridged by fabric or the like, described elsewhere herein.

The lateral support 14 and medial support 16 are joined together at a smaller lower support section 20; as indicated in FIG. 1, the lower support section 20, which is generally opposite the strap system 12, can be significantly smaller and provide less support than the supports 14, 16, because it is less necessary to generate support from the bottom portions of the breast when the woman is recumbent. Optionally, the supports 14, 16 can be additionally joined together directly between them, such as by the further inclusion of fabrics or the like (suggested by the dotted lines in FIG. 1), in order to provide additional medial and lateral support for the recumbent woman's breast. Further optionally, if additional medial and lateral support is desired for the recumbent woman's breasts, the strap systems 12 can further include cross-supports 22, indicated generally by the dotted lines connecting the top portion of the left strap system 12 to the right supports 14, 16, and the dotted lines connecting the top portion of the right strap system 12 to the left supports 14, 16. The cross-supports 22 can provide additional support for the inferior-most breast by providing a support which is more directly opposed to that of gravity, when the woman is recumbent.

Figure 3:
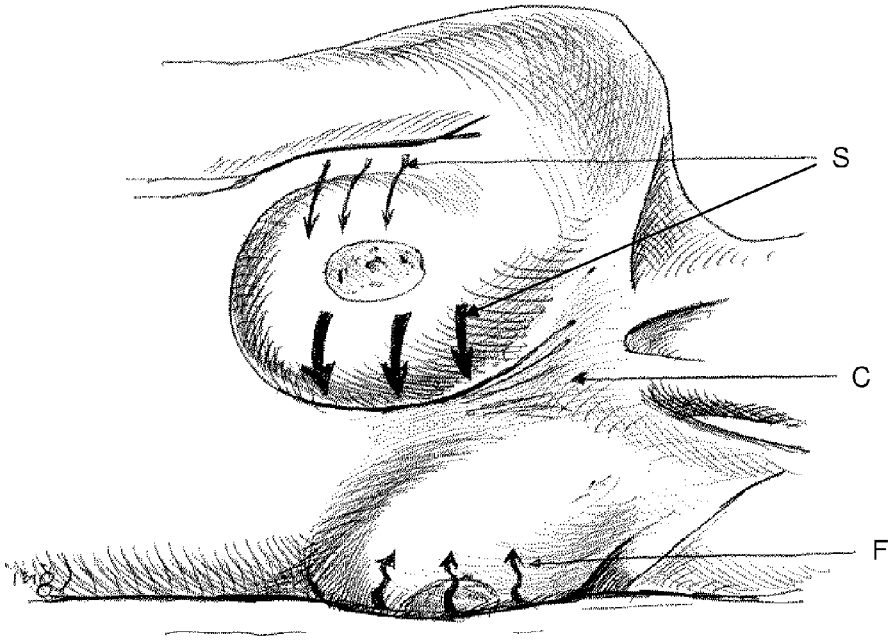
FIG. 3 illustrates the breasts of a recumbent women and the deleterious stresses and forces generated on breast tissue and adjacent tissue, when the woman lies on her side.
Figure 4:
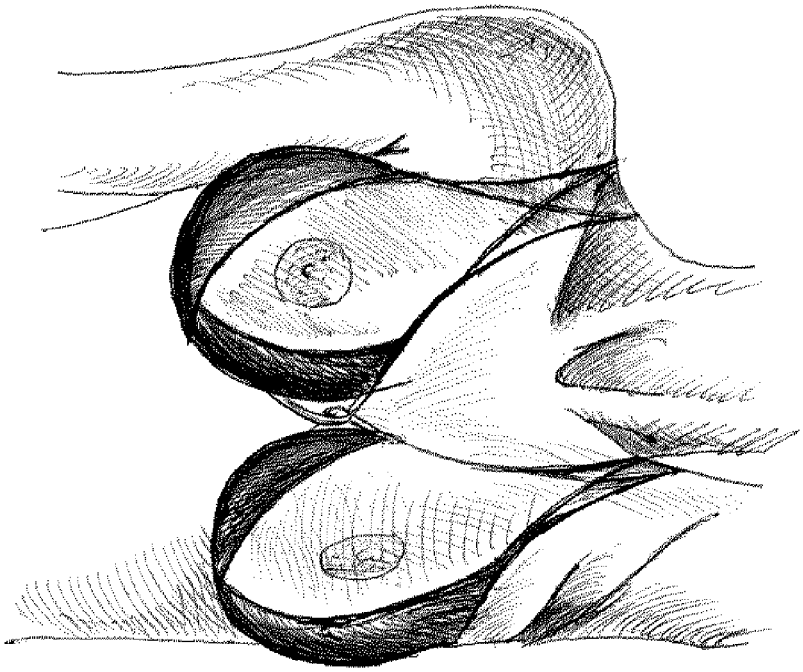
FIG. 4 illustrates a view similar to that of FIG. 3, with an exemplary device of the present invention supporting the breasts.

These unique positions of the supports 14, 16 differentiate a support system 10 of the present invention from prior support bras. The support system 10 and the pads thereof are designed and positioned to withstand and counteract the forces exerted upon the breast in the recumbent position, especially when a woman is sleeping on her sides as illustrated in FIGS. 3 and 4, while prior support bras include significant vertical support sections, while providing little or no augmented medial and lateral support.

Figure 2:
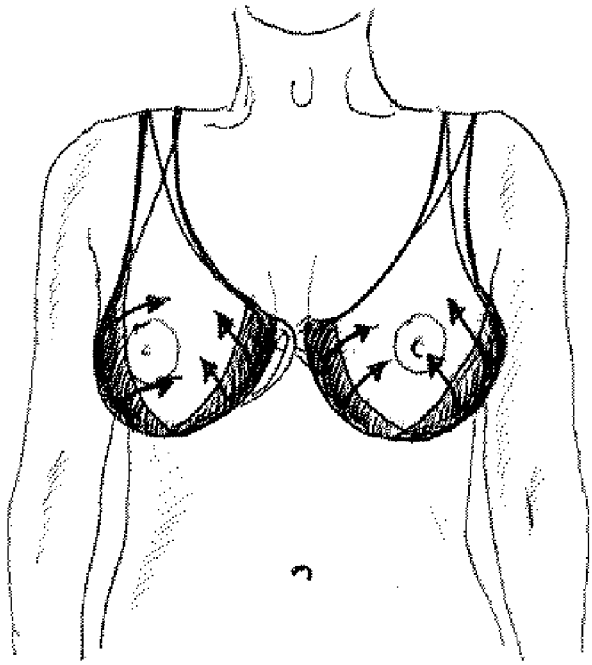
FIG. 2 illustrates a view similar to that of FIG. 1, showing lines of force generated by the exemplary device.

FIG. 2 illustrates the directions of the forces generated by the support 10, which are caused by the positioning of the lateral and medial pads relative to the breast and to the shoulder straps. The support 10 of the present invention generates forces which oppose and counteract the gravity forces on the breasts, in particular the skin and Cooper's ligaments, when the woman is in a recumbent position.

The supports 14, 16, can be formed of any suitable material, but are advantageously constructed to be sufficiently rigid to transmit the forces necessary to provide the medial and lateral support described herein, yet are preferably contoured and soft enough to be comfortably worn. The system 10 is preferably, although not necessarily, constructed of natural and/or synthetic fabrics, in manners well know to those of skill in the art, and further includes clasps and adjustment mechanism commonly incorporated in brassieres.

Figure 5:
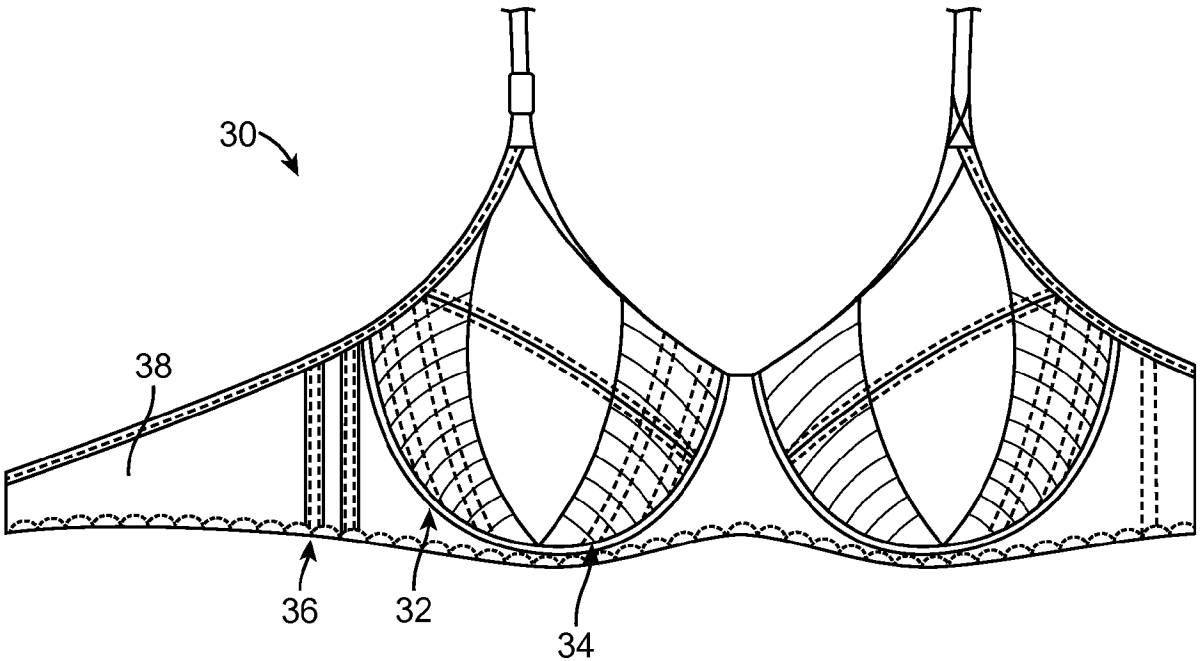
FIG. 5 illustrates a front elevational view of another device embodying principles of the present invention.

FIG. 5 illustrates yet another support 30 embodying principles of the present invention, which is similar in many respects to the embodiment illustrated in FIGS. 1 and 2. The support 30 includes, in addition to the features described with reference to support 10, one or more ribs or vertical rigid supports 32, 34 extending along or through at least one of the left medial support, the right medial support, the left lateral support, and the right lateral support. Advantageously, the vertical supports 32, 34 generally extend along the length of the support, e.g. generally from the vertex of the 'V' formed by each pair of medial and lateral supports. Optionally, horizontal ribs (not illustrated) can be provided in the supports instead of or in addition to the vertical supports 32, 34. Vertical rigid supports 36 can also optionally be provided in the band 38. The vertical supports 32, 34, 36 provide additional support by causing the support(s) to be more rigid. Alternatively, the vertical supports 32, 34, 36 can be further augmented by, or replaced by, a thickened pad or the like in the support. Further optionally, the support(s) can include magnets or other such devices which can have a therapeutic effect on the breast tissue.

Figure 6:
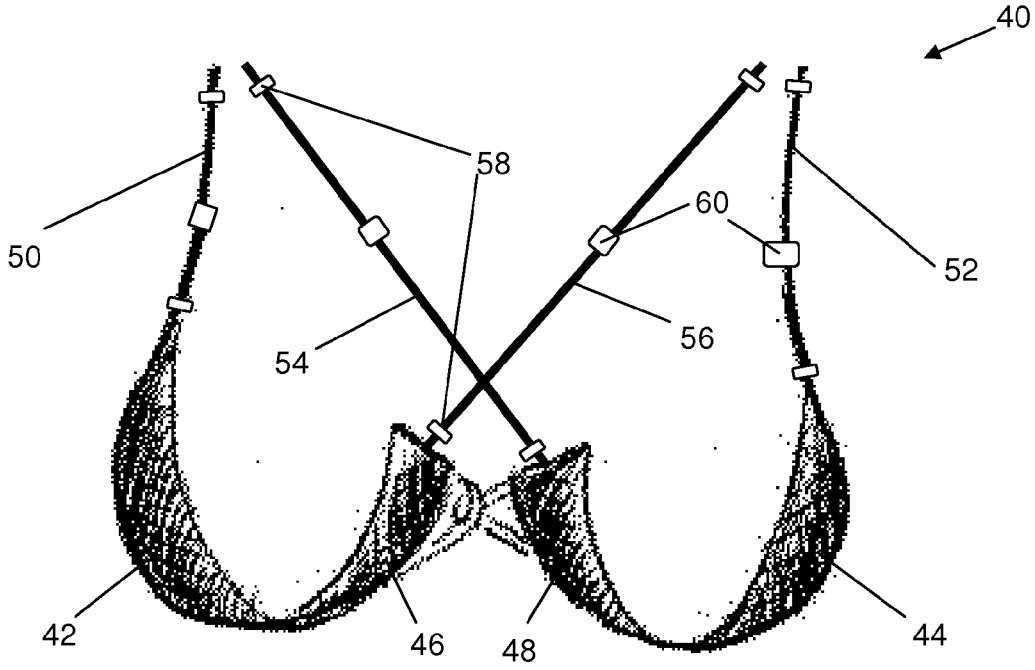
FIG. 6 illustrates a front elevational view of yet another device embodying principles of the present invention.

FIG. 6 illustrates yet another exemplary embodiment, 40, which is similar in many respects to other embodiments described herein and optionally includes their features. As with other embodiments, the support 30 includes right lateral 42, left lateral 44, right medial, and left medial supports or paddings, with the two medial supports being releasably or permanently joined together. As illustrated in FIG. 6, a front strap system is connected to each of the supports, and is connected to a back strap system (not illustrated) such as those commonly used in brassiere construction. The front strap system includes an adjustable, releasable front strap 50, 52, 54, 56, for each of the supports 42-48, respectively. To permit the front strap system to be adjustable, each front strap includes a length adjustment system, as are commonly incorporated into the rear strap systems of commercially available brassieres, and includes a pair of loops 58 through which the straps double back and a slide 60 to which one end of the looped back strap is attached. Optionally, the front strap system includes, on each of the four front straps, a releasable clasp or fastener, which can be incorporated into one of the loops 58 or can be separate therefrom, so that each strap can be selectably released and re-fastened with the matching portion of the same strap, or advantageously with a portion of another strap of the front strap system. By way of non-limiting example, when the releasable fasteners of the two medial front straps are released, they can be cross-fastened (the left medial support connected to the right front strap, and the right medial support connected to the left front strap), as illustrated in FIG. 6, or any other permutation of straight and cross-connection of straps and supports.

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents.

I claim:

1. A breast support system for a recumbent woman comprising:

a left medial support and a right medial support, the medial supports being joined together;

a left lateral support and a right lateral support;

wherein the left medial support is positioned adjacent to the left lateral support and forms a V-shape therewith configured and arranged to support a left breast of said recumbent woman;

wherein the right medial support is positioned adjacent to the right lateral support and forms a V-shape therewith configured and arranged to support a right breast of said recumbent woman; and a strap system attached to both V-shapes, the strap system configured and arranged to extend over the shoulders of said recumbent woman, the strap system including a left lateral strap connected to the left lateral support and configured to extend over the woman's left shoulder, a right lateral strap connected to the right lateral support and configured to extend over the woman's right shoulder, a left medial strap connected to the left medial support and configured to extend over the woman's right shoulder, a right medial strap connected to the right medial support and configured to extend over the woman's left shoulder.

2. The breast support system according to claim 1, wherein each of the left medial and right medial straps include a releasable fastener.

3. The breast support system according to claim 1, wherein each of the front straps includes a length adjustment mechanism.

4. The breast support system according to claim 1, wherein the medial and lateral supports each include top and bottom portions, and wherein the strap system is attached to top portions of the medial and lateral supports.

5. The breast support system according to claim 1, wherein the medial and lateral supports each include top and bottom portions, and wherein the left medial support bottom portion is connected to the left lateral support bottom portion, and wherein the right medial support bottom portion is connected to the right lateral support bottom portion.

* * * * *